US009658600B1

(12) United States Patent
Jeon

(10) Patent No.: US 9,658,600 B1
(45) Date of Patent: May 23, 2017

(54) TIMEPIECES FOR SIGHT IMPAIRED

(71) Applicant: William H. Jeon, La Canada Flintridge, CA (US)

(72) Inventor: William H. Jeon, La Canada Flintridge, CA (US)

( * ) Notice: Subject to any disclaimer, the term of this patent is extended or adjusted under 35 U.S.C. 154(b) by 0 days.

(21) Appl. No.: 14/985,228

(22) Filed: Dec. 30, 2015

(51) Int. Cl.
*G04B 25/02* (2006.01)

(52) U.S. Cl.
CPC ..... *G04B 25/02* (2013.01)

(58) Field of Classification Search
CPC ..... G09B 21/003; G09B 21/004; G04B 25/02
USPC ..... 368/230
See application file for complete search history.

(56) References Cited

U.S. PATENT DOCUMENTS 3,438,195 A * 4/1969 Cochin ..... G04B 25/02 368/230
3,648,647 A * 3/1972 Joy ..... G04F 3/00 116/205
5,311,487 A * 5/1994 Mininni ..... G04G 9/08 368/230
6,218,958 B1 * 4/2001 Eichstaedt ..... G08B 6/00 340/4.12
6,625,088 B1 * 9/2003 Mah ..... G04B 19/207 368/230
8,483,018 B2 * 7/2013 Anderson ..... G09B 21/004 368/230
2002/0050923 A1 * 5/2002 Petersen ..... G09B 21/004 340/407.1
2005/0135198 A1 * 6/2005 Wellen ..... G04G 21/00 368/230
2012/0319981 A1 * 12/2012 Habas ..... G09B 21/008 345/173
2013/0017516 A1 * 1/2013 Tyler ..... G09B 21/004 434/114
2013/0149674 A1 * 6/2013 Anderson ..... G09B 21/004 434/114

* cited by examiner

*Primary Examiner* — Amy Cohen Johnson
*Assistant Examiner* — Jason Collins

(57) ABSTRACT

A timepiece includes: a plurality of pins mounted along a circumferential direction on a face of the timepiece, each of the pins having a first end and a second end opposite the first end; and a pin mover configured to rotate along the circumferential direction of the timepiece, the pin mover being configured to engage the second ends of the pins to move the first ends of the pins away from the face of the timepiece.

15 Claims, 5 Drawing Sheets

TIMEPIECES FOR SIGHT IMPAIRED

BACKGROUND

1. Field

The present invention relates to timepieces, and in particular, to timepieces for blind people.

2. Description of the Related Art

With the advent of the electronic devices, it has become very easy for people to tell time, not using dedicated timepieces (e.g., watches or clocks) but using a variety of hand-held devices. Devices such as smart phones, personal data assistants (PDAs) and the like have made it more convenient for people to tell time. However, these devices do not help blind people to tell time better. It is desirable to come up with watches that are easy to be used for those who cannot see.

Further, when you are on a boring date, it can be perceived as being rude to look at your watch all the time. Looking at the smart phone or any other electronic device to see time could also be viewed as being rude. This may be the same for people during business meetings. They may not necessarily want to look at their wrist in front of important customers, for example. The watch for blind people can also be used by anyone who wants to look at time without being rude.

In addition, to ensure wide accessibility of the watch, the mechanism of the watch should be simple such that it can be built relatively inexpensively using relatively inexpensive parts and materials.

SUMMARY

According to embodiments of the present invention, timepieces (e.g., watches or clocks) for sight impaired are provided. While the present invention will be described primarily in reference to watches, embodiments of the present invention apply equally as well to clocks as those skilled in the art would appreciate.

A timepiece according to example embodiments of the present invention includes: a plurality of pins mounted along a circumferential direction on a face of the timepiece, each of the pins having a first end and a second end opposite the first end; and a pin mover configured to rotate along the circumferential direction of the timepiece, the pin mover being configured to engage the second ends of the pins to move the first ends of the pins away from the face of the timepiece.

The face of the timepiece may have a plurality of openings therethrough arranged along the circumferential direction, the openings being configured to allow corresponding ones of the pins to pass therethrough.

Each of the pins may include at least one flange configured to keep the pins from being separated from the timepiece.

A plurality of openings may be located on the face, wherein the pins are configured to move through the openings.

The at least one flange may include a first flange on the pin body at one side of the face and a second flange on the pin body at another side of the face, such that the first and second flanges prevent the pin from being separated from the timepiece.

The timepiece may further include a cover covering the timepiece, the cover having a plurality of openings corresponding to the openings of the face.

The timepiece may further include a cover having a plurality of openings configured to allow portions of the pins to move therethrough.

The timepiece may further include a membrane covering the plurality of pins, wherein the first ends of the pins are configured to engage the membrane when moved upward.

The plurality of pins may include a first plurality of the pins and a second plurality of the pins, the first plurality of the pins being located nearer to a periphery of the timepiece than the second plurality of the pins.

The pin mover may include a first pin mover configured to engage the first plurality of the pins and a second pin mover configured to engage the second plurality of the pins.

The pin mover may have a first slope at its leading edge to gradually move the pins upward.

The pin mover may have a second slope at its trailing edge to gradually move the pins downward.

The timepiece may further include a plurality of protrusions corresponding to at least one of the hours or minutes.

The timepiece may further include a protrusion to indicate AM or PM.

The plurality of pins may be biased in a direction toward a position.

A timepiece according to other example embodiments of the present invention includes: a membrane including a plurality of pins mounted along a circumferential direction thereon, each of the pins having a first end and a second end opposite the first end; and a pin mover configured to rotate along the circumferential direction of the timepiece, the pin mover being configured to engage the second ends of the pins to move the first ends of the pins in a direction away from the timepiece.

A timepiece according to other example embodiments of the present invention includes: a face; a plurality of protrusions mounted on the face, the plurality of protrusions being configured to indicate minutes and hours; and a plurality of actuators to move the plurality of protrusions to indicate time.

The timepiece may further include a protrusion to indicate AM or PM.

The timepiece may further include a driver for driving the plurality of actuators.

These and other features and embodiments will be described using the below drawings.

DETAILED DESCRIPTION

Figure 1:
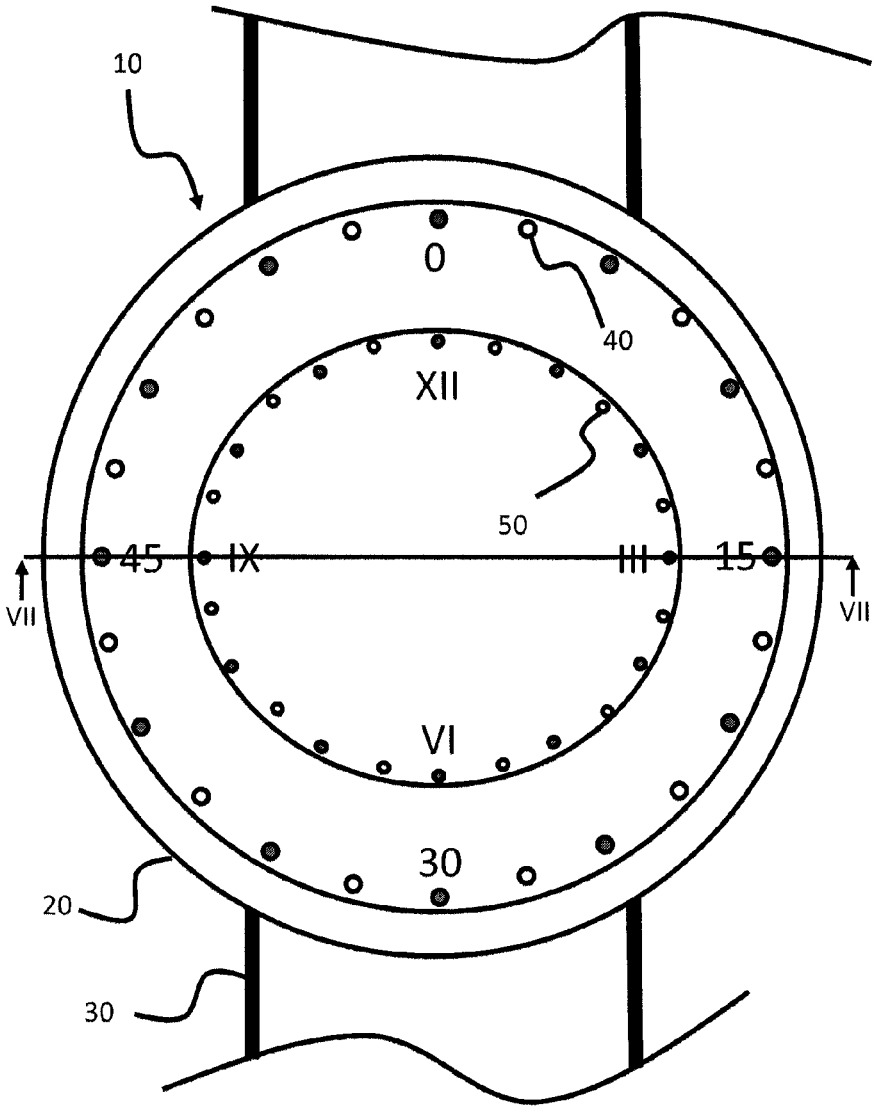
FIG. 1 is a front view of a timepiece according to embodiments of the present invention.

FIG. 1 is a front view of a timepiece (e.g., a watch) 10 according to embodiments of the present invention. The watch 10 includes a timepiece body (e.g., a watch body) 20 and a strap (e.g., a watch strap) 30. The watch body 20 has on its face two rings of pins 40 and 50 for indicating time. The outer ring including the pins 40 is for indicating minutes and the inner ring including the pins 50 is for indicating hours. In other embodiments, the outer ring may be used to indicate hours and the inner ring may be used to indicate minutes. In further embodiments, the watch may include only one ring for indicating time (e.g., hours). In still further embodiments, additional rings may be used to indicate seconds, days of the week and/or month. Further, while not shown in FIG. 1, timepieces according to embodiments of the present invention may also include an AM/PM indicator to indicate whether the time is before or after noon.

The moving mechanism of the watch (or timepiece) 10 may be mechanical, quartz, electrical and/or electronic that is known to those skilled in the art. For example, those skilled in the art of watch making should be able to practice the embodiments of invention described herein without undue experimentation after thoroughly reviewing and understanding the embodiments disclosed herein.

While the description of the pins 40 and 50 may be provided primarily in reference to the pins 50 of the inner ring for indicating hours hereinbelow, those skilled in the art would understand that the description may apply just as well to the pins 40 of the outer ring for indicating minutes.

The pins 50 of the watch body 20 are mounted along a circumferential direction on an inner region of the face of the watch body. While 24 pins are shown in FIG. 1, the number of pins could be more or less. For example, the watch body in another embodiment may include only 12 pins, one per each hour. Further, the watch body can include more than 24 pins, so that the hour and time between the hours can be more precisely indicated.

While the strap 30 for wearing the watch on the wrist is seen as being attached to the watch body 20 to form the watch 10, the strap 30 is not required. Rather, the watch according to other embodiments of the present invention may be a pocket watch with or without an attached chain, or may be worn as a necklace around the neck and/or may be configured to be worn on any other suitable part of the human body. Further, while a watch is illustrated in FIG. 1, and the present invention will be described primarily in reference to a watch, embodiments of the present invention can be applied to any other suitable timepieces such as clocks (e.g., wall clocks or desk clocks).

Figure 2:
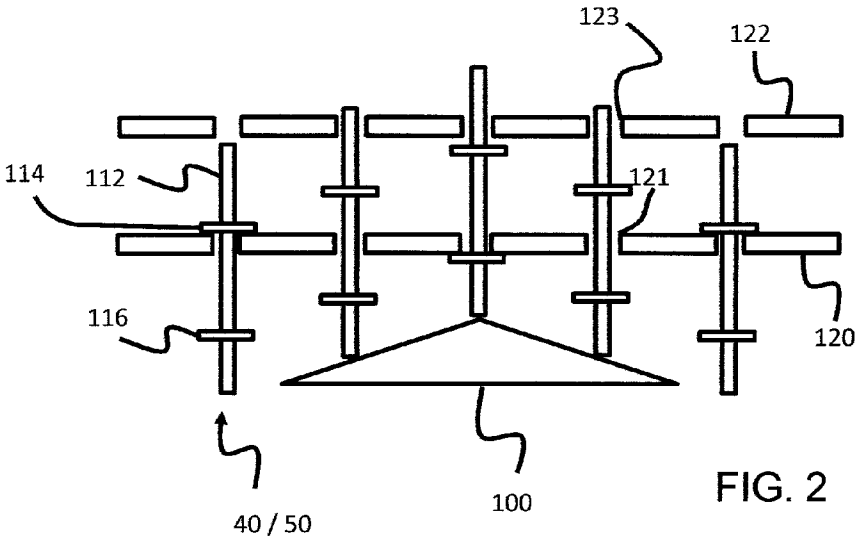
FIG. 2 is a schematic drawing of a mechanism for operating the watch according to some embodiments of the present invention.
Figure 3:
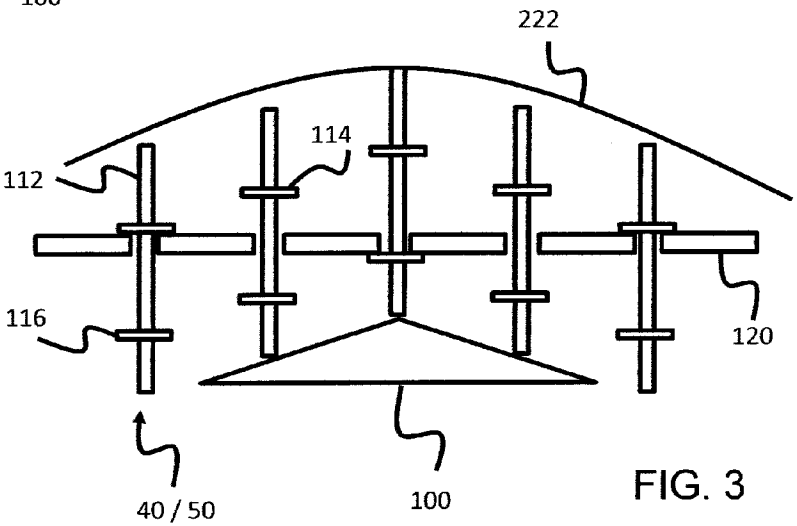
FIG. 3 is a schematic drawing of a mechanism for operating the watch according to some embodiments of the present invention.

FIGS. 2 and 3 show operation mechanism of the watch 10 according to example embodiments of the present invention. The embodiments illustrated in FIGS. 2 and 3 are substantially similar to each other, except that the watch body in FIG. 2 includes a cover (e.g., a transparent cover) 122 covering the front face of the watch body, while the watch body in FIG. 3 includes a membrane (e.g., a flexible membrane) 222 for covering the front face of the watch body.

The cover 122 may be made of glass, plastic and/or any other suitable material. For example, because the watch is primarily designed to be worn and used by blind people, the cover 122 may not be transparent in other embodiments. For example, the cover 122 may be made of stainless steel, aluminum, colored plastic, and/or the like. The cover 122 has a plurality of openings 123 formed therethrough for allowing the pins 40/50 to move through them, such that at least a portion of the pins extend to outside of the watch body 20 to be touched by a person using/wearing the watch. While FIG. 2 shows some gap between the peripheral surface of the openings 123 and portions of the pins 40/50 (e.g., pin body 112) that goes through the respective openings 123, FIG. 2 is not drawn to scale, and in practice the pin body 112 may have substantially the same cross-sectional size as the opening 123 such that the gap between the pin body 112 and the peripheral surface of the opening 123 is reduced or minimized. This way, penetration of water, moisture, and/or other foreign substance through the openings 123 is prevented, reduced or minimized. Respective interfacing surfaces between the openings 123 and the pin bodies 112 may be made slippery (e.g., lubricated) through selection of the materials and/or coatings thereon, such that the pin bodies 112 can slide through the openings 123 with relative ease.

The membrane 222 may be made of any natural or man-made substance that is suitable for covering the pins, and allows relatively easy movement of the pins by lifting a portion or portions of the membrane 222. Further, in some embodiments, the membrane 222 may be made of waterproof or water-resistant material so as to prevent, reduce or minimize the penetration of moisture, water, or any other foreign substance through the membrane. For example, the membrane 222 may be made of any polymer and/or any other suitable plastic and/or any other material that is waterproof.

While only two structures (the cover 122 having the plurality of openings 123 and the membrane 222) are illustrated in FIGS. 2 and 3, the present invention is not limited thereto. For example, any other suitable cover known to those skilled in the art may be used to allow the pins to be detected by the user/wearer via touching, while at the same time, protecting the pins and other structures inside the watch body.

Because the structure of the operation mechanism for the watch body in FIGS. 2 and 3 are substantially similar, the description will be made primarily in reference to the embodiment illustrated in FIG. 2 with the understanding that the embodiment of FIG. 3 is substantially the same except for the cover 122 in FIG. 2 and the membrane 222 in FIG. 3.

Each of the pins 40/50 includes a pin body 112, an upper flange (or a first flange) 114 and a lower flange (or a second flange) 116. The timepiece face (e.g., watch face) 120 has a plurality of openings 121 arranged along a circumferential direction corresponding to the location of the pins. The openings 121 are sized such that the pin body 112 can move (or pass or slide) therethrough while the flanges 114 and 116 are not allowed to pass therethrough. Similarly, the openings 123 of the cover 122 are sized to allow the pin body therethrough while the upper flange 114 cannot pass through.

Similar to the size relationships between the pin bodies 112 and the openings 123 discussed above, FIG. 2 is not drawn to scale, and in practice the pin body 112 may have substantially the same cross-sectional size as the opening 121 such that the gap between the pin body 112 and the peripheral surface of the opening 121 is reduced or minimized. This way, penetration of water, moisture, and/or other foreign substance through the openings 121 is prevented, reduced or minimized. Respective interfacing surfaces between the openings 121 and the pin bodies 112 may be made slippery (e.g., lubricated) through selection of the materials and/or coatings thereon, such that the pin bodies 112 can slide through the openings 121 with relative ease.

The flanges 114 and 116 prevent the pin from being separated from the watch face 120, such that the pins can move up and down in the direction normal to the watch face 120 while not being separated therefrom. For example, the upper flanges 114 prevent the first end of the pins 40/50 from falling into the watch body while the lower flanges 116 preventing the pins 40/50 from completely disengaging the openings 121 and falling out of the watch body 20.

The operation mechanism also includes a pin mover 100 that moves in a circumferential direction around the watch body 20. The pin mover 100 has a sloped leading edge (a first end or a leading end) and a sloped trailing edge (a second end or a trailing end). In other embodiments, the pin mover may only have a slope at one of the ends. Because the pin mover 100 has a slope, as the pin mover moves around the watch body, the first end starts to engage the second ends of the pins in sequence so as to lift the first ends of the pins 40/50 up sequentially through the openings 123. As the pins move upward and downward in sequence, the user/wearer can feel the first ends (e.g., upper ends) of the pins such that he/she can tell time through touching only. In order to prevent the pins from dropping suddenly/abruptly back into the watch body 20, the pin mover 100 of the described embodiment is also sloped at the trailing end such that the first ends of the pins 40/50 gradually move downward into the watch body 20 in a controlled manner.

While the pin mover 100 and the alignment of the pins in FIGS. 2 and 3 appears to be flat (e.g., the cross section appears flat and in a same plane), the pins 40/50 are actually arranged in a circle as shown in FIG. 1. Also, the pin mover 100 may have a curved shape (e.g., an arc of the a circle) that corresponds to the radius of curvature of the watch body 20, such that as the pin mover 100 moves around the circumference of the watch body 20, the leading edge slope and the trailing edge slope of the pin mover 100 engage the circularly (or circumferentially) arranged pins in sequence so that they can move upward slowly and then downward slowly in sequence.

Further, while the watch body 20 has a shape of a circle, in other embodiments, the watch body may have a variety of different suitable shapes as those skilled in the art would appreciate. For example, the watch body may have a rectangular (e.g., square) shape or a hexagonal shape. In these other embodiments, the pins 40/50 are still arranged along a circle and the pin move 100 still moves around the watch body along a circumferential direction.

As discussed above, the embodiment of FIG. 3 includes a membrane 222 instead of the cover 122. The membrane 222 has sufficient strength (or durability) to not tear or break when the pins push upward to lift portions thereof. Further, the membrane 222 has sufficient flexibility for the pins to push portions of the membrane 222 upward with relative ease.

The upper surfaces (e.g., sloped leading and trailing surfaces) of the pin mover are lubricated or otherwise made sufficient slippery, such that the low ends of the pins 40/50 can move upward while the pin mover 100 moves with relatively low resistance along the circumferential direction while moving the circularly (or circumferentially) arranged pins in an upwardly direction in sequence.

Figure 4:
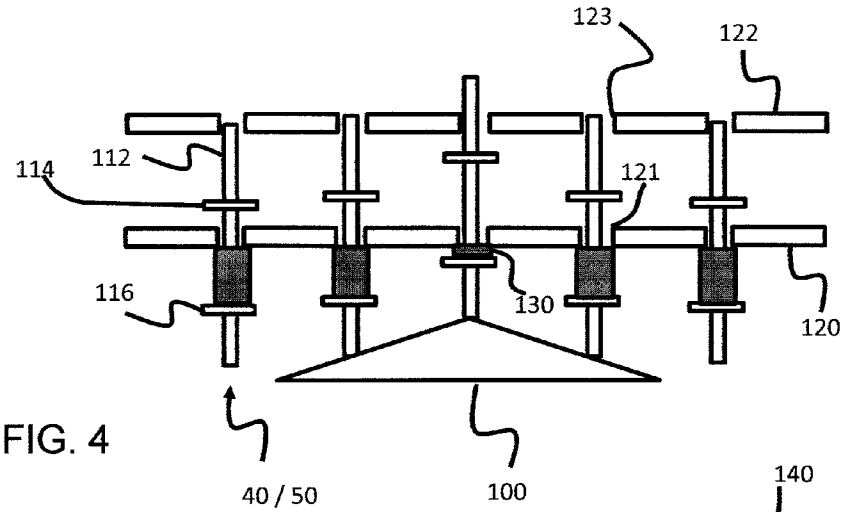
FIG. 4 is a schematic drawing of a mechanism for operating the watch according to some embodiments of the present invention.

The timepiece illustrated in FIG. 4 is substantially identical to that of FIG. 2 except that each of the pins 40/50 are spring loaded. For example, each of the pins has mounted thereon spring 130 located below the watch face 120 and the lower flange 116. In some embodiments, the spring 130 is physically attached to both the watch face 120 and the lower flange 116. The spring prevents or substantially prevents the pin 40/50 from moving upward without being biased by the pin mover 100. When the pin mover 100 engages the lower end of the pin body 112, the spring is compressed and the upper end of the pin body 112 moves upward and through the opening 123. As the pin mover rotates around, the trailing slope of the pin mover 100 allows the spring to be gradually uncompressed, thereby allowing the pin 40/50 to move back to its normal position. Those skilled in the art would know how to select the spring constant such that the pins 40/50 can be moved in a controlled manner without hindering the movement of the pin mover 100. Also, the spring arrangements can be different to improve or optimize biasing of the pins 40/50 without departing from the spirit or scope of the present invention.

Figure 5:
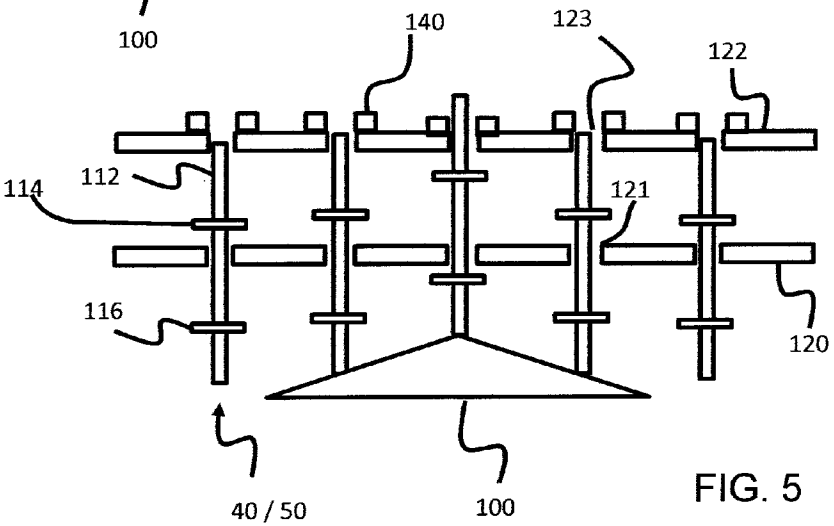
FIG. 5 is a schematic drawing of a mechanism for operating the watch according to some embodiments of the present invention.

The timepiece illustrated in FIG. 5 is substantially identical to that of FIG. 2 except that a circular protrusion 140 surrounds each of the openings 123 formed on the cover 122. The circular protrusion allows the wearer of the watch to be able to feel the location of the pin relative to other pins on the timepiece to make it easier for the user to know which of the pins has currently moved upward. While a schematic cross-section of the circular protrusion 140 is illustrated in FIG. 5, the present invention is not limited thereto. The protrusions can have any suitable size or shape, and can even be numbers or Braille numbers that are formed on the cover 122 to be felt with finger tips of the wearer.

Figure 6:
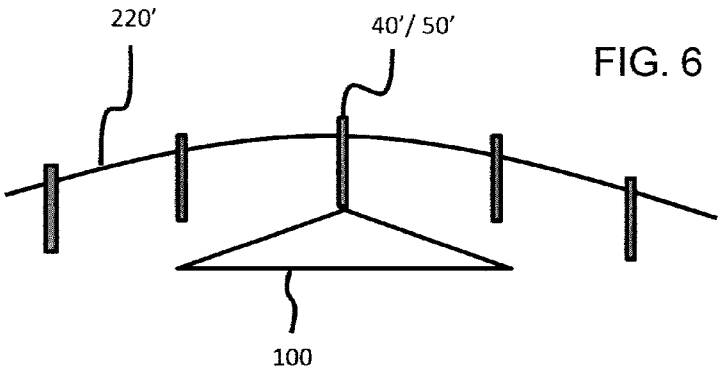
FIG. 6 is a schematic drawing of a mechanism for operating the watch according to some embodiments of the present invention.

According to the example embodiment of FIG. 6, pins 40' and 50' are located at locations substantially corresponding to pins 40 and 50, respectively, of FIG. 1. However, the pins of FIG. 6 are different in that they are mounted directly on a flexible membrane 222'. The membrane 222' is substantially identical to the membrane 222 of FIG. 3 and is made of substantially the same material as the membrane 222. However, pins 40' and 50' are mounted directly on the membrane 222' such that when the pin mover 100 engages a lower end of the pin 40'/50', an upper end of the pin is protruded upward such that a wearer can feel that the pin has moved upward in comparison to the other pins on the timepiece.

Further, while pins are described herein as the moveable pieces, the present invention is not limited thereto, and any suitable movable mechanism such as cantilevers, leaf springs, protrusions, and/or any other suitable structures known to those skilled in the art may be used to implement the moveable pieces.

Figure 7:
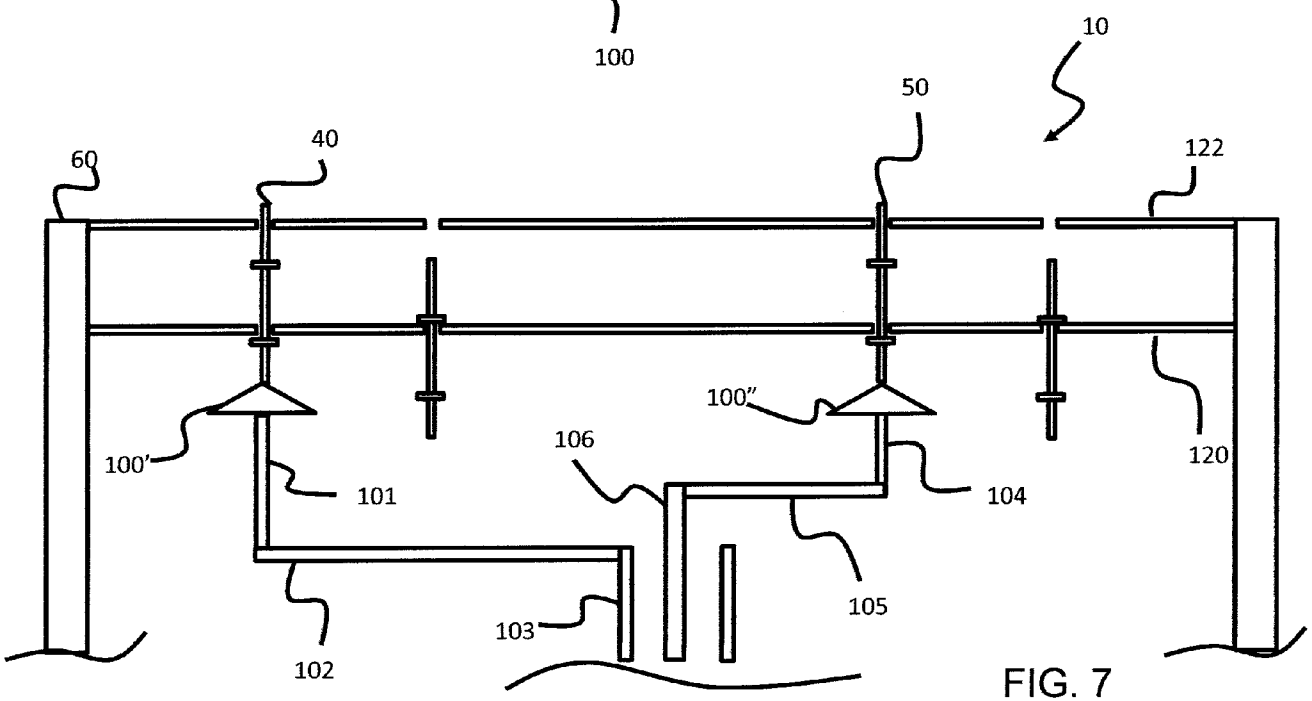
FIG. 7 is a schematic cross-sectional diagram taken along the line VII-VII of FIG. 1.

FIG. 7 is a schematic cross-sectional diagram taken along the line VII-VII of the timepiece 10 of FIG. 1. As can be seen in FIG. 7, the timepiece 10 has a wall or bezel 60 that surrounds the periphery (e.g., circumference) of the timepiece body 20. The wall or bezel 60 holds the timepiece face 120 and the cover 122 in their respective positions relative to each other.

There are two pin movers 100' and 100". The pin mover 100' is configured to engage and move the pins 40 near the periphery of the watch body 20. The pin mover 100" is configured to engage and move the pins 50 that are closer to the center of the watch body 20 than the pins 40.

The pin mover 100' is mounted on a horizontal rod 102 via a vertical rod 101. The horizontal rod 102 may be replaced by a disk or a gear in other embodiments. The horizontal rod 102 rotates in a clockwise direction in accordance with the rotation of a cylinder 103 that shares a central axis with a central axis of the watch. This way, as the cylinder 103 rotates in a circumferential direction of the timepiece body 20, the pin mover 100' moves around the periphery (e.g., circumference) of the timepiece body 20 to sequentially move the pins 40, thereby indicating minutes.

The pin mover 100" is mounted on a horizontal rod 105 via a vertical rod 104. The horizontal rod 105 may be replaced by a disk or a gear in other embodiments. The horizontal rod 105 rotates in a clockwise direction in accordance with the rotation of a central rod 106 that is co-axial to the cylinder 103 and shares a central axis with the central axis of the watch. This way, as the central rod rotates in a circumferential direction of the timepiece body 20, the pin mover 100" moves around the periphery (e.g., circumference) of the timepiece body 20 to sequentially move the pins 40, thereby indicating the hour of the day.

Those skilled in the art, of course, would appreciate that the moving mechanism of the timepiece 10 can be substantially the same as a conventional watch or a clock that includes a number of moving parts such as gears for moving hour, minute and second hands. For example, the moving mechanism for the hour hand can be used to move or drive the pin mover 100", while the moving mechanism for the minute hand can be used to move or driver the pin mover 100'.

Figure 8:
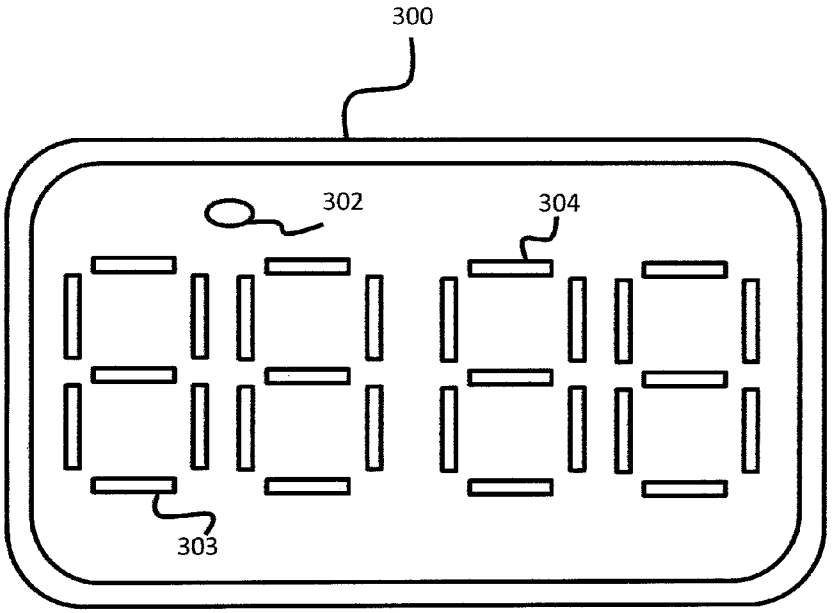
FIG. 8 is a front view of a timepiece according to another embodiment of the present invention.

FIG. 8 is a front view of a timepiece (e.g., watch or clock) 300 according to other embodiments of the present invention. As can be seen in FIG. 8, the timepiece 300 includes a plurality of protrusions 303 and 304 for respectively indicating hours and minutes. As can be seen in FIG. 8, each group of 7 protrusions can represent any number between and including '0' and '9'. The protrusions 303 and 304 are mounted on an actuator that moves up and down in accordance with the time and hour of the day, so as to indicate numbers that represent time (hour and minute). The timepiece further includes an AM/PM indicator 302 that can be used to indicate whether the time is before or after noon. For example, when the AM/PM indicator is protruding, it may indicate PM, and when it is not protruding, it may indicate AM, or vice versa.

Figure 9:
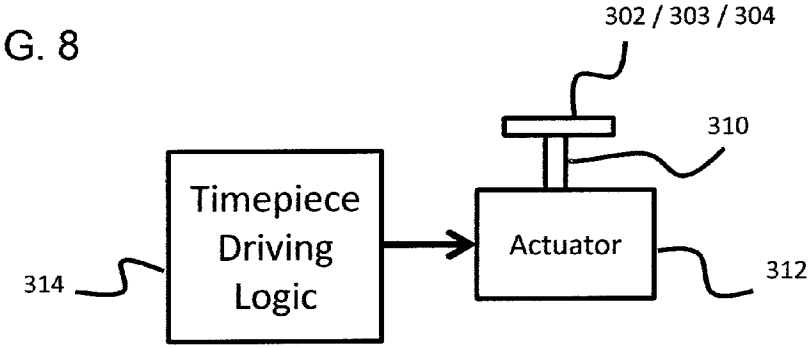
FIG. 9 is a schematic diagram illustrating an actuation mechanism of the timepiece 300 of FIG. 8

FIG. 9 is a schematic diagram illustrating an actuation mechanism for the AM/PM indicator 302 and/or the protrusions 303 and 304. Each of the protrusions (and/or the AM PM indicator 302) is mounted on a corresponding actuator 312 via a supporting rod 310. Based on the status of the actuator, the AM/PM indicator 302 and/or the protrusions 303 and 304 may move up or down to indicate different hours and minutes of the day. The actuator 312 is controlled by a timepiece driver (or timepiece driving logic) 314. The timepiece driver 314 as well as the actuator 312 may be powered by battery, such as for example, a lithium battery. The timepieces according to embodiments of the present invention may be operated mechanically or via electricity, and may run using solar power. Further, the battery used may be charged via wall outlet, by an external battery, by electricity generated through physical movements, and/or solar power.

Those skilled in the art would know how to implement the logic and moving mechanisms of the timepiece 300. For example, the actuator 312 may be implemented using MEMS technology and/or any other actuator technology known to those skilled in the art. Further, the timepiece driver 314 for driving the actuators can be implemented using any combination of hardware, firmware, software, microprocessor, microcontroller, FPGA and/or discrete circuit components known to those skilled in the art. For example, anyone skilled in designing logic circuitry for a conventional digital watch should be able to design logic circuitry for the timepiece 300 with ease.

While the timepiece 300 has protrusions that represent alphanumeric symbols, the present invention is not limited thereto. For example, the symbols represented by the timepiece in other embodiments may be Braille numbers consisting of dots. In such embodiments, dots would replace the protrusions, but the actuating mechanism and the driving logic would substantially be the same as or similar to those of the timepiece 300 as those skilled in the art would appreciate.

Also, while not shown explicitly in FIG. 8, those skilled in the art would understand that the timepiece 300 may also include a cover with openings or slits corresponding to the protrusions 303 and 304 so that a user can touch and/or feel the protrusions 303 and 304 through the openings or slits in the cover.

While the present invention has been described herein with reference to specific examples, the present invention is not limited thereto. For example, those skilled in the art would appreciate that one or more features of one or more embodiments of the present invention may be combined with one or more other suitable features of any other embodiments. The scope of the present invention is to be defined herein via the following claims and their equivalents.

What is claimed is:

1. A timepiece comprising:

a plurality of pins mounted along a circumferential direction on a face of the timepiece, each of the pins having a first end and a second end opposite the first end; and a pin mover configured to rotate along the circumferential direction of the timepiece, the pin mover being configured to engage the second ends of the pins to move the first ends of the pins away from the face of the timepiece, wherein each of the pins comprises at least one flange configured to keep the pins from being separated from the timepiece, wherein a plurality of openings are located on the face, wherein the pins are configured to move through the openings, and wherein the at least one flange comprises a first flange on the pin body at one side of the face and a second flange on the pin body at another side of the face, such that the first and second flanges prevent the pin from being separated from the timepiece.

2. The timepiece of claim 1, wherein the plurality of openings are arranged along the circumferential direction.

3. The timepiece of claim 1, further comprising a cover covering the timepiece, the cover having a plurality of openings corresponding to the openings of the face.

4. The timepiece of claim 1, further comprising a cover having a plurality of openings configured to allow portions of the pins to move therethrough.

5. The timepiece of claim 1, wherein the plurality of pins comprises a first plurality of the pins and a second plurality of the pins, the first plurality of the pins being located nearer to a periphery of the timepiece than the second plurality of the pins.

6. The timepiece of claim 5, wherein the pin mover comprises a first pin mover configured to engage the first plurality of the pins and a second pin mover configured to engage the second plurality of the pins.

7. The timepiece of claim 1, wherein the pin mover has a first slope at its leading edge to gradually move the pins upward.

8. The timepiece of claim 7, wherein the pin mover has a second slope at its trailing edge to gradually move the pins downward.

9. The timepiece of claim 1, further comprising a plurality of protrusions corresponding to at least one of the hours or minutes.

10. The timepiece of claim 1, further comprising a protrusion to indicate AM or PM.

11. The timepiece of claim 1, wherein the plurality of pins are biased in a direction.

12. A timepiece comprising:

a plurality of pins mounted along a circumferential direction on a face of the timepiece, each of the pins having a first end and a second end opposite the first end;

a pin mover configured to rotate along the circumferential direction of the timepiece, the pin mover being configured to engage the second ends of the pins to move the first ends of the pins away from the face of the timepiece; and a membrane covering the plurality of pins, wherein the first ends of the pins are configured to engage the membrane when moved upward.

13. A timepiece comprising:

a membrane comprising a plurality of pins mounted along a circumferential direction thereon, each of the pins having a first end and a second end opposite the first end; and a pin mover configured to rotate along the circumferential direction of the timepiece, the pin mover being configured to engage the second ends of the pins to move the first ends of the pins in a direction away from the timepiece.

14. The time piece of claim 13, further comprising a protrusion to indicate AM or PM.

15. The timepiece of claim 13, further comprising a driver for driving the plurality of actuators.

* * * * *